US005421397A

United States Patent [19]

Hembree et al.

[11] Patent Number: 5,421,397

[45] Date of Patent: Jun. 6, 1995

[54] METHOD OF AND SYSTEM FOR CASTING ENGINE BLOCKS HAVING DEFECT FREE THIN WALLS

[76] Inventors: Robert K. Hembree, 8695 Fessler-Buxton, Piqua, Ohio 45356; Mark L. Purtee, 1577 Sussex Rd., Troy, Ohio 45373

[21] Appl. No.: 5,846

[22] Filed: Jan. 19, 1993

[51] Int. Cl.[6] ..... B22D 17/22; B22D 17/32; B22D 27/04

[52] U.S. Cl. ..... 164/457; 164/4.1; 164/113; 164/125; 164/126; 164/154.6; 164/338.1; 164/348

[58] Field of Search ..... 164/458, 457, 4.1, 113, 164/122, 125, 126, 128, 150, 154, 151.4, 155.6, 154.6, 348, 338.1

[56] References Cited

U.S. PATENT DOCUMENTS

| | | | |
|---|---|---|---|
| 3,903,956 | 9/1975 | Pekrol | 164/125 X |
| 4,072,181 | 2/1978 | Kostura et al. | 164/154 |

FOREIGN PATENT DOCUMENTS

| | | | |
|---|---|---|---|
| 1282865 | 11/1968 | Germany | 164/154.6 |
| 2035715 | 1/1972 | Germany | 164/154 |
| 2807880 | 9/1978 | Germany | 164/154 |
| 57-1540 | 1/1982 | Japan | 164/125 |
| 62-33054 | 2/1987 | Japan | 164/458 |
| 63-47118 | 2/1988 | Japan | 164/154.6 |
| 1-143750 | 6/1989 | Japan | 164/458 |
| 1-210161 | 8/1989 | Japan | 164/348 |
| 4-200954 | 7/1992 | Japan | 164/348 |
| 508336 | 5/1976 | U.S.S.R. | 164/338.1 |

*Primary Examiner*—J. Reed Batten, Jr.

*Attorney, Agent, or Firm*—Vorys, Sater, Seymour and Pease

[57] ABSTRACT

An improved method of and system for die casting an engine block made of aluminum is provided. Included in the system is a calorific fluid for circulating through a bore pin assembly in a preselected temperature range which is continuously maintained by a heat transfer fluid controlling device.

22 Claims, 2 Drawing Sheets

10
12
14
14
14
14
52
52
52
52
22
22
22
22
24
24
44
26
28
30
HEATER
40
HEAT EX-CHANGER
38
CONTROLLER
TEMPERATURE SENSOR 50
48
OIL RESERVOIR
36
34
32
46

METHOD OF AND SYSTEM FOR CASTING ENGINE BLOCKS HAVING DEFECT FREE THIN WALLS

BACKGROUND OF THE INVENTION

The present invention is related generally to a method of and system for producing metal castings and, in particular, an improved method of and system for producing aluminum engine blocks and the like having thin cylinder walls which are substantially free of defects.

A variety of casting processes and materials have been proposed in the automobile industry for manufacturing engine blocks. One material commonly utilized is cast iron. Cast iron has gained wide acceptance over the years because it is relatively easy and inexpensive to cast as well as to subsequently machine the same. Also, a variety of different casting methods are used for casting blocks and these include sand casting followed by permanent die casting; low pressure die casting; and, high pressure die casting. Manufacturers are attempting to meet the demands for lighter, more compact and higher performance engines, and aluminum is generally favored for these purposes. Different techniques are used for producing cast aluminum blocks. One known process includes use of a low pressure die casting system, another is an evaporative casting process, such as the so-called lost foam process that utilizes sand dies and STYROFOAM (expanded polystyrene) filters; the latter of which evaporates. Yet other known processes include high pressure die casting, gravity casting, and sand casting.

The newer engine blocks have closer dimensions and tolerances and thin wall sections. One area of concern is the location of the cylinders because they are positioned to be in very close proximity to each other, and hence have relatively thin walls therebetween. Because of these very small spaces between the cylinders there is a possibility that portions of the aluminum cylinder wall will prematurely solidify before the entire block and, thus create areas having microscopic cracks.

For a variety of reasons, it is desirable to utilize cylinder sleeves made of cast iron in aluminum engines. One known high pressure die casting technique for producing such blocks does so by inserting the sleeve in the mold and subsequently mold the engine block therearound.

Disadvantages of the foregoing techniques in dealing with aluminum engine blocks are that microscopic defects can be formed at zones of non-uniform solidification or zones of contact with different materials (e.g. cast iron sleeves). Also, it is possible for the core pins used in the mold for forming the cylinders to distort thereby forming residual stresses in the mold not to mention damage to the bore pin. The noted defects to the engine are not detected easily and often show up only after the block is machined. As a consequence, there are ongoing efforts to improve upon the manufacturing of engine blocks having thin walls and especially such blocks made of aluminum or other similar materials.

SUMMARY OF THE INVENTION

In accordance with the principles of the present invention there is provided an improved method of and system for producing castings, such as automotive engine blocks made of aluminum or other like materials in which the blocks are substantially free of defects.

In an illustrated embodiment, there is a method of die casting a cylinder block defining at least a cylinder bore therein. The method includes the steps of forcing molten metal into a die cavity to form a die cast block having walls defining at least a cylinder bore therein formed by a fluid-coolable bore pin; passing a fluid through the bore pin for controlling the temperature of the bore pin within a predetermined range, and thereby controlling die temperature of the molten metal forming the walls of the bore; and allowing the molten metal to solidify; the improvement comprising: passing a heat transfer fluid through the bore pin in a preselected temperature range which is maintained generally continuously to control the temperature along a predetermined length of the bore pin in the predetermined range so as to control the temperature of the adjacent molten metal around the bore pin to thereby avoid premature cooling and solidification of such molten metal. In addition stresses and distortion of the bore pin are minimized to thereby minimize residual stresses and distortion of the cast block walls defining the bore.

In another illustrated embodiment, the step of maintaining the temperature along the bore pin within the predetermined range includes the steps of passing the heat transfer fluid through the bore pin in a closed loop system, monitoring the temperature of the bore pin, and heating/cooling the heat transfer fluid exiting the bore pin so that it reenters the bore pin within the preselected temperature.

In yet another illustrated embodiment, the step of monitoring the temperature of the bore pin includes monitoring the temperature of the heat transfer fluid exiting the bore pin. In still another illustrated embodiment, the step of monitoring the temperature of the bore pin includes directly monitoring the temperature of the bore pin walls.

In another illustrated embodiment the step of passing the heat transfer fluid through the bore pin includes using a calorific liquid, such as white mineral oil.

In still another illustrated embodiment, there is provided a system of die casting a cylinder block having walls defining at least a cylinder bore therein. The system comprises a high pressure die casting device defining a die cavity and at least a fluid coolable bore pin for defining the bore, such that the molten metal is forced into the die cavity to form the die cast block having the cylinder bore formed by the bore pin. The device includes means for passing a liquid through the bore pin for controlling the temperature of the bore pin to a value within a predetermined range, and thereby control the die temperature of the molten metal forming the walls of the bore. The improvement comprises: means for passing a heat transfer fluid through said bore pin in a preselected temperature range which is maintained generally continuously to control the temperature of the bore pin within the noted predetermined range along a predetermined length of the bore pin. This is done so as to control the temperature of the molten metal around the bore pin to thereby avoid premature solidification of such molten metal, as well as minimize stresses and distortion of the bore pin and thereby minimize residual stresses and distortion of the cast block walls defining the bore.

In yet another embodiment, there is provided means for controlling the temperature along the bore pin to within the preselected temperature range. It includes means for passing the heat transfer fluid through the bore pin in a closed loop system; means for monitoring the temperature of the bore pin and, means for heating-/cooling the heat transfer fluid in the closed loop system exiting the bore pin in the closed loop system so that the fluid reenters the bore pin within the preselected temperature range.

In another illustrated embodiment, the means for heating/cooling the heat transfer fluid includes heater means operable for increasing the temperature of the fluid, and heat exchanger means for cooling the fluid.

Among the objects and features of the present invention are the provisions for: an improved method of and system for controlling casting engine blocks and the like having defect free thin-walls; an improved method of and system for producing aluminum engine blocks having thin cylinder walls which are substantially free of defects; an improved method of and system of the foregoing type in which the cylinder bores of the engine block are formed in a high pressure die casting procedure utilizing bore pin assemblies; an improved method of and system for die casting engine blocks as noted above which continuously monitors heat transfer fluid passing through the bore pin assemblies in a preselective temperature range so as to avoid premature solidification of the molten metal in the die cavity as well as minimize stresses and distortions of the bore pin; an improved method of and system as last noted which minimizes residual stresses and distortions of the cast block walls defining the cylinder walls; an improved method of and system for casting engine blocks of aluminum, as noted, in which the preselected temperature is continuously maintained through the selective operation of a heat exchanger or heater which cooperates with the circulated fluid; an improved method of and system, as aforenoted, which utilizes a calorific fluid which does not change phase during casting, thereby ensuring generally uniform temperature control of the bore pin assembly and surrounding molten metal; and, therefore, avoid creating distortions of the bore pin assembly and residual stresses and distortions of the cast cylinder wall.

These and other features and advantages of the invention will become apparent from a detailed written description of the invention which follows taken in conjunction with the accompanied drawings.

DETAILED DESCRIPTION

Figure 1:
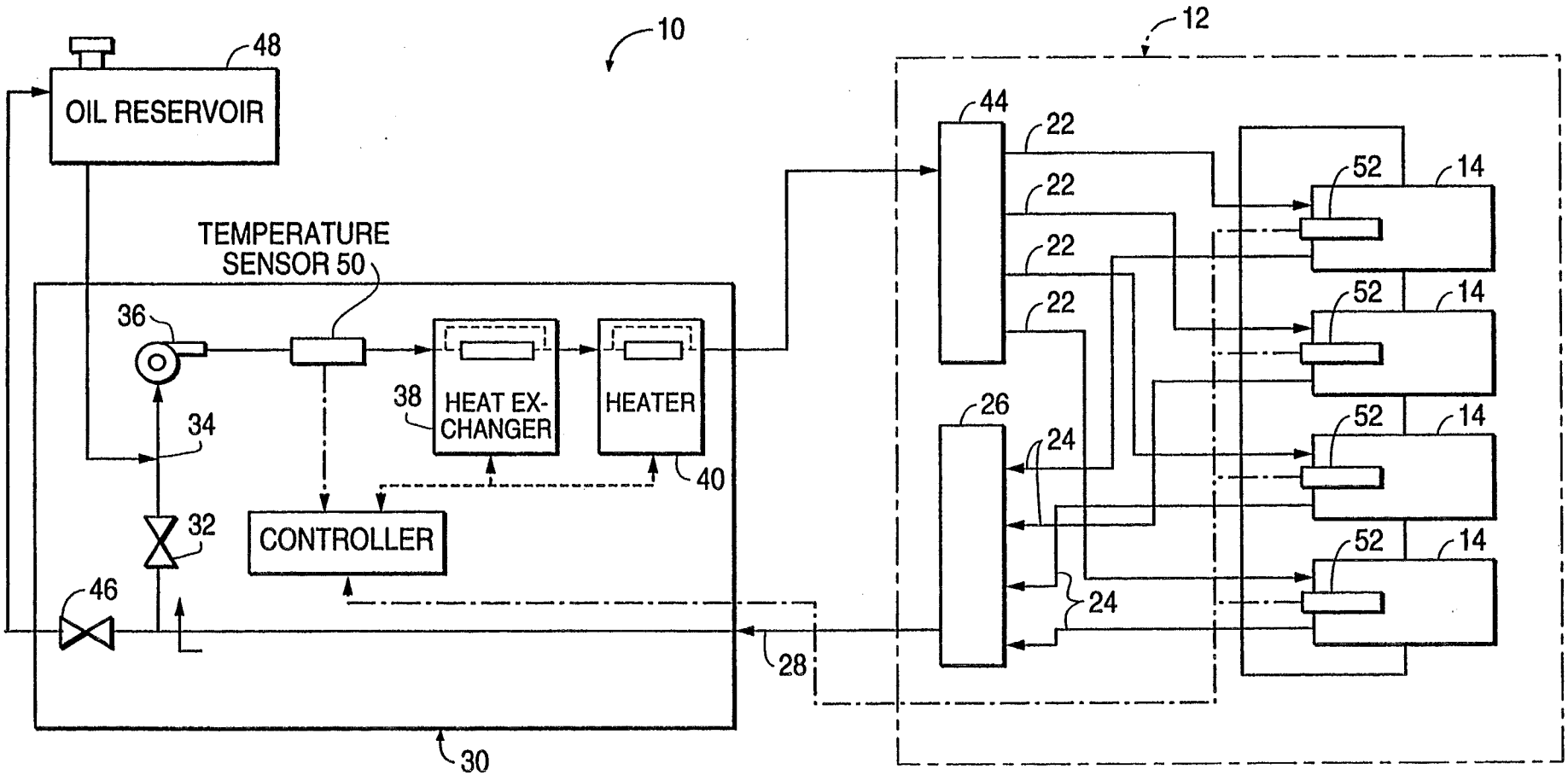
FIG. 1 is a schematic view of a system embodying the principles of the present invention; and, FIG. 2 is a schematic illustration of a bore pin assembly usable in the system of the present invention.
Figure 2:
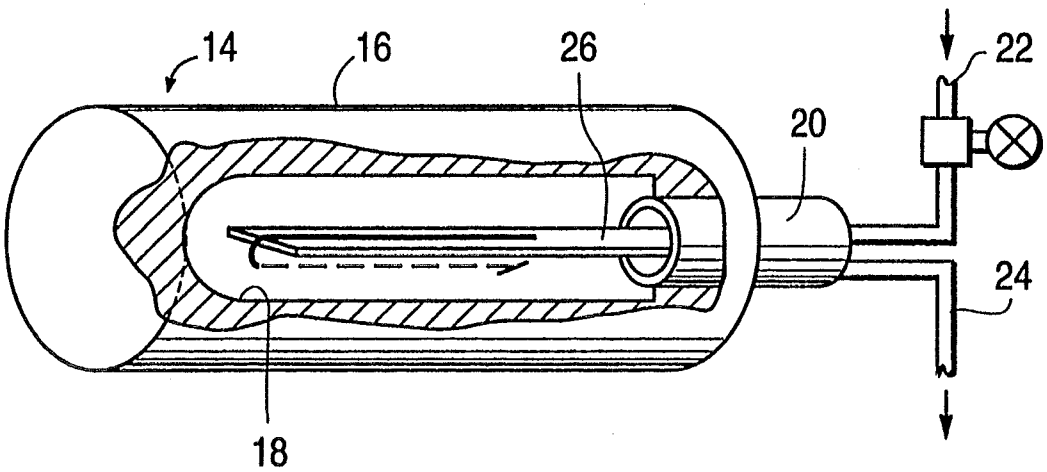

Reference is made to FIGS. 1 and 2 for illustrating one preferred embodiment of an improved casting system 10 made according to the principles of the present invention and which is adapted for casting automobile engine blocks (not shown) and the like. Although the present embodiment is for use in the production of automobile engine blocks, it will be appreciated that the invention is applicable to the formation of other objects, especially objects having thin walls for which it is desired to insure continued proper heating of the molten metal forming such thin-walls so as to avoid premature solidification in the cast thin-walled regions, as well as minimize stresses and distortions of cavity core components and, thus any residual stresses and distortions of the cast product itself. In addition, while the present embodiment is directed to the utilization of aluminum and aluminum alloys for casting such engine blocks, it will be appreciated that other casting metals can be employed consistent with the spirit and scope of this invention.

With continued references to in FIG. 1, the casting system 10 includes a high pressure die casting device 12, which can be one of several known types used for casting automobile engine blocks and the like. The die casting device 12 includes a plurality of fluid-cooled bore pin assemblies 14, each for manufacturing a cylinder bore in a cylinder block. In actual practice the bore pin assemblies 14 extend into the die casting device 12 (i.e. into the plane of the paper). However, for ease of understanding the present embodiment, the bore pins assemblies 14 (FIG. 1) are depicted in an orientation which is at ninety degrees (90°) relative to their actual orientation. The system 10 contemplates use of different kinds of bore pin assemblies, such as a water cooled fountain type (not shown) or a blade style bore pin (FIG. 2). Each bore pin assembly 14 includes a hollow cylindrical sleeve 16 made of appropriate materials for performing die casting functions. Centrally disposed within the sleeve 16 is an elongated interior cooling cavity 18 that fluidly cooperates with a known type of fluid fitting assembly 20 that is adjacent one end of the cooling cavity 18. The fluid fitting assembly 20 is constructed to regulate fluid flow into and out of appropriate fluid inlet and outlet lines 22 and 24; respectively. A centrally disposed flat blade 25 is coupled to the fitting assembly 20 and ensures that the heat transfer fluid introduced into the cavity 18 runs substantially the length of the cavity before it exits to the fluid outlet line 24.

The fluid outlet line 24 associated with each bore pin assembly 14 is fluidly coupled to an outlet die manifold assembly 26. A fluid outlet line 28 from the outlet die manifold assembly 26 travels to a die temperature controller generally depicted by reference numeral 30. The die temperature controller 30 is in a closed loop system with the die casting device 12 so as to regulate the temperature of the heat transfer fluid (not shown) flowing 15 through each of the bore pin assemblies 14. In this embodiment, the die temperature controller 30 can be of the type obtainable from Quality Process Control Systems, Hudsonville, Mich., U.S.A. The output from the outlet die manifold assembly 26 travels through a valve 32, passed an oil reservoir inlet 34, and through pump 36. The pump 36 is operable for circulating the heat transfer fluid through the entire closed loop system including a heat exchanger 38, and a fluid heater 40. The heat exchanger 38 and heater 40 are in series along a fluid line 42. The fluid line 42 is effective for transferring the heat treating fluid at a preselected temperature from the die temperature controller 30 to an inlet die manifold 44. A plurality of fluid lines 46 from the inlet die manifold assembly 44 lead to respective fluid inlets 22 of each bore pin assembly 14. The die temperature controller 30 also includes a valve 46 which returns the heat transfer fluid to an oil reservoir 48. In one embodiment, the fluid flows through a temperature sensor 50, which provides a reading of the temperature of the exited fluid from bore pin assemblies 14. A signal is sent to the controller 30 which is controlled to provide a set point temperature in a preselected range which is desired for controlling the temperature of the fluid reentering the bore pin assemblies 14. In this manner the molten metal can be at the desired temperature for casting anyone blocks. In this particular embodiment, the transfer fluid can be heated to a temperature value of about 260° C. to 300° C. for aluminum of the type used for automobile engine blocks.

The controller 30 is operable for effecting operation of either the heat exchanger 38 or the heater 40 for purposes of cooling or heating the returned fluid to the preselected set temperature value. The temperature value is, of course, determined by the type of cooling of the bore pin assembly 14 that is envisioned for each casting.

In the present embodiment use is made of a calorific fluid, such as white mineral oil, rather than water. White mineral oil changes phase from a liquid to a gaseous form above about 300° C. This transfer fluid has been found to be ideal for purposes of high pressure die casting aluminum. Basically, white mineral oil will not change phase at temperatures which are required for successfully casting aluminum. The present invention envisions, of course, that other kinds of heat transfer fluid can be utilized in conjunction with the present system. However, because white mineral oil changes phase at a higher temperature than water, there is a greater degree of temperature consistency along the length of the internal cavity 18 of each bore pin assembly 14 than there is with a water/steam mixture. Accordingly, there is less likelihood that the bore assembly will distort and/or become stressed.

In an alternate embodiment, each bore pin assembly 14 includes a thermocouple device 52 which can be attached to the internal wall of the bore pin assembly 14. The thermocouple device 52 is operable for purposes of real time sensing of the temperature therein and transmitting such value to the controller 30. As noted, the controller unit 30 is set to a desired temperature set-point in a preselected range. The controller 30 compares the received signals from either one of the sensor 50 or 52 to the selected set-point temperature. Following such a comparison, the controlling unit 30 sends a signal to either the heat exchanger 38 or the heater 40 for purposes of having the latter cool or heat the fluid, respectively, so that the fluid reaches the set-point temperature. It is to be appreciated that the desired temperature of the oil is dependent upon the amount of heat that must be transferred to the cavity from the die. Of course, the heat dissipation of the fluid through the system and the bore pin assemblies are functions of the bore pin and die assemblies and are calculatable using known methods.

For instance, if the bore pin begins to heat-up, the temperature is sensed by either one of the temperature sensors. When the oil temperature is sensed above that set-point temperature, the controller unit 30 sends a signal to operate the heat exchanger 38 to start cooling the oil. The cooled oil is transferred back to the bore pin assemblies so as to cool the latter to fall within the preselected range. As the bore pin assemblies begin to cool and the oil from the die cools below the set-point of the controller 30, the heater 40 is operable to heat the oil and, in turn, the bore pin assemblies 14. This heat/-cool cycle continuously maintains the bore pin assembly temperatures to a preselected temperature range. This temperature range is dependent upon the die and bore pin design as noted above.

After having explained the above construction of the casting system 10 made according to the principles of the present invention its operation is self-evident. When utilizing the system 10 several advantages are achievable in the castability and production of cylinder blocks or other like objects. In this regard, the system 10 is able to continuously maintain a consistent cylinder bore pin temperature range during the casting cycle. Because of the system's use of a calorific material as white mineral oil, the system also tends to eliminate uneven heat dissipation associated with water cooling of such bore pins assemblies. The system 10 also eliminates the likelihood of cast iron cylinder sleeves sticking on each bore pin assemblies during the casting process as well as eliminates microscopic cracks and the normal internal stresses associated with bore pin distortion that typically accompanies water cooled bore pin assemblies. Accordingly, such facilitates the removal process of the cast block from the casting die by maintaining sleeve to bore pin assembly tolerances. In addition the system eliminates premature solidification of the aluminum or other casting materials. Moreover, the system 10 better maintains good adherence of the cylinder sleeves to the casting material around the cylinder bores by improving the flow of aluminum material around the bore pin assemblies.

Certain changes may be made in the above described system and method without departing from the scope of the invention involved and it is intended that all matter contained in the description thereof or shown in the accompanying drawing shall be interpreted as illustrative and not in a limiting sense.

What is claimed:

1. A method of die casting a cylinder block defining at least a cylinder bore therein, comprising the steps of:

forcing molten metal into a die cavity to form a die cast cylinder block having walls defining at least a cylinder bore therein formed by a fluid-coolable bore pin;

passing a heat transfer fluid through the bore pin in a preselected temperature range which is maintained generally continuously to control the temperature along a predetermined length of the bore pin in the predetermined range so as to control the temperature of the molten metal around the bore pink to thereby avoid premature cooling and solidification of such molten metal, and minimize stresses and distortion of the bore pin, and consequently minimize residual stresses and distortion of the cast block walls defining the bore.

2. The method of claim 1, wherein said step of passing a heat transfer fluid through the bore pin includes the steps of:

passing the heat transfer fluid through the bore pin in a closed loop system, monitoring the temperature of the bore pin, and heating/cooling the heat transfer fluid exiting the bore pin so that it reenters the bore pin within the preselected temperature.

3. The method of claim 2, wherein said step of monitoring the temperature of the bore pin includes monitoring the temperature of the heat transfer fluid exiting the bore pin.

4. The method of claim 3, wherein said step of monitoring the temperature of the bore pin includes directly monitoring the temperature of the bore pin walls.

5. The method of claim 2, wherein the heat transfer fluid is heated by a heater and cooled by a heat exchanger, the heater and heat exchanger being controlled so that the heat transfer fluid is maintained at a temperature within said preselected range.

6. The method of claim 1 wherein said step of passing the heat transfer fluid through the bore pin includes using a calorific liquid.

7. The method of claim 6 wherein the heat transfer fluid changes phase at about 300° C. or above.

8. The method of claim 7 wherein the heat transfer fluid is white mineral oil.

9. The method of claim 1, wherein said step of forcing molten metal into the die cavity includes forcing metals of the group including aluminum and aluminum alloys into the die cavity.

10. The method of claim 1, wherein said preselected temperature range is from about 260° C. to 300° C. when the metal being cast is aluminum.

11. The method of claim 1, wherein a cylinder sleeve is cast in the block by inserting the sleeve around the bore pin before casting, and by regulating the temperature of the bore pin so that the molten metal is in a temperature range which avoids premature solidification of such molten metal, and minimizes stresses and distortion of the bore pin and sleeve.

12. The method of claim 1, wherein said step of forcing the molten metal into the die cavity is accomplished by high pressure injection.

13. A system of die casting a cylinder block having walls defining at least a cylinder bore therein, said system comprising:

a high pressure die casting device defining a die cavity and at least a fluid coolable bore pin for defining the bore, wherein molten metal is forced into said die cavity to form the die cast block having the cylinder bore formed by the bore pin; and means for passing a heat transfer fluid through said bore pin in a preselected temperature range which is maintained generally continuously to control the temperature of said bore pin within said predetermined range along a predetermined length thereof, so as to control the temperature of the molten metal around said bore pin to thereby avoid premature solidification of such molten metal, and minimize stresses and distortion of said bore pink and consequently minimize residual stresses and distortion of the cast block walls defining the bore.

14. The system of claim 13, wherein said means for controlling the temperature along said bore pin to within said preselected temperature range includes:

means for passing the heat transfer fluid through said bore pin in a closed loop system, means for monitoring the temperature of said bore pink and means for heating/cooling the heat transfer fluid in said closed loop system exiting said bore pin in said closed loop system so that the fluid reenters said bore pin within said preselected temperature range.

15. The system of claim 14, wherein said monitoring means includes means for monitoring the temperature of the exited heat transfer fluid.

16. The system of claim 14, wherein said monitoring means includes means for directly monitoring the temperature of the bore pin walls.

17. The system of claim 14, wherein said means for heating/cooling the heat transfer fluid includes heater means operable for increasing the temperature of the fluid, and heat exchanger means for cooling the fluid.

18. The system of claim 14, wherein said temperature controlling means is operable to maintain the fluid in said preselected temperature range of from about 260° C. to 300° C. when the metal being cast is aluminum.

19. The system of claim 13, wherein said means for passing the heat transfer fluid through said bore pin includes use of a calorific liquid as said transfer fluid.

20. The system of claim 19, wherein said calorific liquid changes phase at about 300° C. or above.

21. The system of claim 20, wherein said calorific liquid is white mineral oil.

22. The system of claim 13, wherein whenever a cylinder sleeve is cast in the block by inserting the sleeve around said bore pin before casting, said temperature controlling means maintains the temperature of the molten metal around said sleeve in a temperature range which avoids premature solidification of the molten metal, and minimizes stresses and distortions of said bore pin and sleeve.

* * * * *